US005709230A

United States Patent [19]

Miraglia

[11] Patent Number: 5,709,230

[45] Date of Patent: Jan. 20, 1998

[54] TRIPLE ZONE MASCARA BRUSH

[75] Inventor: Loretta A. Miraglia, Monsey, N.Y.

[73] Assignee: E-L Management Corporation, New York, N.Y.

[21] Appl. No.: 623,762

[22] Filed: Mar. 29, 1996

[51] Int. Cl.[6] ..... A45D 40/26

[52] U.S. Cl. ..... 132/218; 132/216; 132/320; 132/313; 132/317; 15/206

[58] Field of Search ..... 132/216, 218, 132/320, 313, 317; 15/206, 160, 207.2, DIG. 5, DIG. 6; 401/129

[56] References Cited

U.S. PATENT DOCUMENTS

| | | | |
|---|---|---|---|
| 3,896,823 | 7/1975 | Spatz . | |
| 4,433,928 | 2/1984 | Kingsford . | |
| 4,446,880 | 5/1984 | Gueret et al. . | |
| 4,632,136 | 12/1986 | Kingsford . | |
| 4,733,425 | 3/1988 | Hartel et al. . | |
| 4,861,179 | 8/1989 | Schrepf et al. . | |
| 4,887,622 | 12/1989 | Gueret . | |
| 4,898,193 | 2/1990 | Gueret | 132/218 |
| 4,964,429 | 10/1990 | Cole . | |
| 4,974,612 | 12/1990 | Gueret . | |
| 4,982,838 | 1/1991 | Fitjer | 132/317 |
| 4,993,440 | 2/1991 | Gueret . | |
| 5,161,554 | 11/1992 | Fitjer . | |
| 5,161,555 | 11/1992 | Cansler et al. . | |
| 5,238,011 | 8/1993 | Gueret . | |
| 5,339,841 | 8/1994 | Gueret | 132/218 |
| 5,345,644 | 9/1994 | Gueret | 15/160 |
| 5,357,987 | 10/1994 | Schrepft . | |
| 5,482,059 | 1/1996 | Miraglia . | |

FOREIGN PATENT DOCUMENTS

WO95/17837 7/1995 WIPO .

*Primary Examiner*—Gene Mancene
*Assistant Examiner*—Pedro Philogene
*Attorney, Agent, or Firm*—Pennie & Edmonds LLP

[57] ABSTRACT

A mascara brush having three sections of differing bristle configuration is disclosed. The brush portion has a larger diameter middle section comprised of a combination of soft and stiff bristles in random configuration, and two end sections, each of which is comprised of at least one bristle type which preferably become progressively shorter towards the ends of the brush portion. The end sections exhibit less bristle density than the middle section. This improved brush configuration allows for optimal one-stroke mascara application.

18 Claims, 2 Drawing Sheets

TRIPLE ZONE MASCARA BRUSH

BACKGROUND OF THE INVENTION

The present invention relates generally to the field of mascara brushes, and in particular to mascara brushes having more than one type of bristle.

The typical mascara brush of the prior art comprises a multiplicity of bristles mounted to a helically twisted wire, such that the free ends of the bristles are disposed in a spiral configuration. The shape of the brush is generally cylindrical, having bristles of uniform length throughout the length of the brush, or conical, having progressively shorter bristles toward the brush tip. Bristle density varies, sometimes according to bristle diameter, but is generally known to be in the range of 10 to 60 bristles per turn. The twisted wire axis is usually supplied with a handle at the end opposite the bristles. This handle also typically serves as the cap for the mascara container which houses the brush when it is not in use and carries the mascara supply.

The conventional mascara brush employs bristles of nylon composition. These bristles are typically cylindrical in shape and have a generally circular cross-section, although many other shapes are taught in the art. The suppleness of the bristle material is essential for the purpose of picking up the mascara from the container and transporting it to the eyelashes. However, this type of bristle often results in clumping during application, because, while the bristles are soft enough to properly transport the mascara, they are too soft to provide the combing effect necessary to achieve uniform distribution of mascara to the eyelashes. As a result, a separate instrument has been required to comb the lashes during application with the conventional brush.

It has been suggested by the prior art to use two different types of bristles in the same brush, i.e., soft bristles for applying the mascara and stiff bristles for combing the applied mascara through the lashes. For example, U.S. Pat. No. 4,964,429 to Cole discloses a mascara applicator with alternating rows of flexible bristles and stiff teeth. U.S. Pat. No. 4,861,179 to Schrepf discloses a spiral mascara brush having soft and stiff bristles randomly intermingled throughout the length of the brush in specific proportion. However, the spiral configuration of these brushes does not allow for a uniform distribution of the bristle tips, which has been found to be better for the purpose of picking up and transferring mascara, especially mascaras of high viscosity.

U.S. Pat. Nos. 4,733,425 and 5,161,554 disclose the use of certain bristle types which, when used with the conventional twisted wire axis, result in a non-spiral bristle configuration. U.S. Pat. No. 4,733,425, for example, discloses the use of hollow bristle fibers which compress when gripped between the wire axis and flare outwardly in a random arrangement. Similarly, U.S. Pat. No. 5,161,554 discloses the use of bristles with varying diameter along the longitudinal axis of the bristle such that they produce a random configuration depending on where they are engaged with the wire axis. However, these patents do not solve the previously addressed problem of clumping without the use of a separate combing implement.

Another proposed solution is disclosed in U.S. Pat. No. 4,887,622 wherein a lesser bristle density is used in combination with a larger diameter and thus stiffer bristle in an attempt to provide a brush which will both evenly apply the mascara and separate the lashes.

Thus, there is a need for an improved mascara brush which allows for optimal transfer of a high viscosity mascara product to the lashes in a single stroke application, by providing maximum exposure of brush to the eyelashes and incorporating a combing implement to eliminate clumping.

SUMMARY OF THE INVENTION

It is an object of the present invention to provide a mascara brush which is capable of both applying mascara and combing the eyelashes so as to provide a uniform distribution of mascara to the eyelashes.

It is another object of the invention to provide a mascara brush which maximizes the exposure of the lash to the mascara thereby providing for single stroke application.

It is a further object of the invention to provide a mascara brush which may be effectively utilized with high viscosity mascara formulations.

It is a still further object of the invention to provide a mascara brush capable of effectively reaching the corners and roots of eyelashes for optimal application of product.

The present invention contemplates an improved mascara brush having three sections or zones of bristle configuration along the length of the brush portion. Each zone is defined by the diameter, length, stiffness and density of the bristles contained therein. Preferably, the effective overall stiffness of the brush varies from zone to zone.

The middle cylindrical section is comprised of a combination of stiff and supple bristles intermingled throughout the section, and each of the end portions is comprised of one or more bristle types, preferably wherein at least one end bristle type is the same as one of the bristle types utilized in the middle section.

The diameter of the middle portion of the brush is preferably 0.325 inches or greater, larger than that of the standard mascara brush. The bristles of the middle section are preferably comprised of a combination of stiff, irregularly-shaped synthetic "goat" fibers of about 0.004 to 0.006 inches in diameter and soft ultrafine fibers of about 0.001 to 0.002 inches in diameter. These fibers are inserted between the legs of a wire axis which has been twisted in a helical formation and inserted into a rod which extends from the cap of the mascara container. By virtue of their irregular shape, the stiff bristles are distributed throughout the middle section of the brush in a non-spiral arrangement.

Each of the end sections of the brush contains one or more bristle types. The bristle composition of the tip end section may differ from that of the base end section. In a preferred embodiment, one of the bristle types used in the middle section of the brush is also used in either or both of the end sections of the brush. However, at least one of the bristle types used in the middle section will be absent from either or both of the tip or base end sections. The bristles contained in at least one of the end portions of the brush are preferably comprised of hollow synthetic fibers of about 0.004 to 0.006 inches in diameter, most preferably of about 0.005 inches. These fibers are gripped between the wire core in the standard fashion, such that the bristles extend out from the wire in a spiral, or helical, configuration. Preferably, one or both of the end sections are tapered such that the bristle length progressively decreases nearer the tip and/or base of the brush. Preferably, one or both of the end sections exhibits greater bristle density than the middle section of the brush. Most preferably, the base end section exhibits the greatest bristle density, followed by the tip end section and lastly by the middle section.

DETAILED DESCRIPTION OF THE INVENTION

Figure 1:
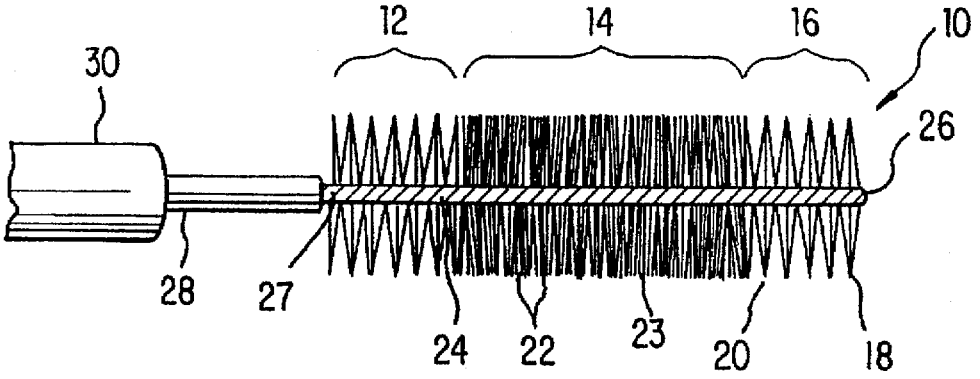
FIG. 1 is a longitudinal side view of a mascara brush according to the present invention.
Figure 6:
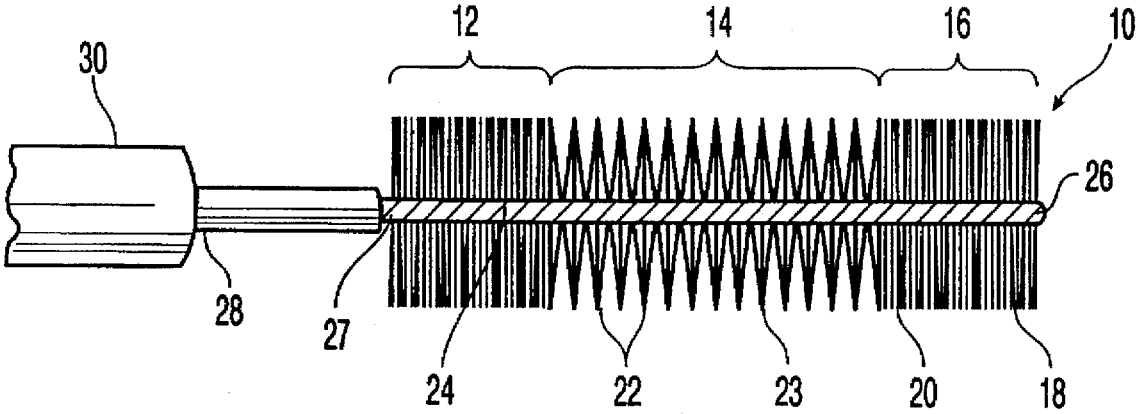
FIG. 6 is a longitudinal side view of a third embodiment of a mascara brush according to the present invention.

A mascara brush according to the present invention is shown in FIGS. 1 and 6. The brush portion 10 is comprised of a plurality of bristles arranged in three distinct sections or zones 12,14,16 throughout the length of the brush—a base end section 12, a middle section 14 and a tip end section 16. The sections are distinguished by the diameter, length, stiffness and density of the bristles found in each section, preferably resulting in a variation in overall effective stiffness from zone to zone. Overall effective stiffness is defined by the diameter, length, stiffness and density of the bristles used in each section such that, all other things be equal, a more densely packed zone will have greater overall effective stiffness than a less densely packed zone.

The bristles of all three sections of the brush are mounted to a metal wire 24 which is bent at its midpoint, forming the brush tip 26, and twisted about itself in a helical configuration as is known in the art. The pitch of the metal helix is preferably about 15.0 to 19.0 turns per inch. The wire 24 of the core has a diameter of about 0.0270 to 0.0290 inches. The bristles are gripped at their midpoints between the twisted wire and extend outwardly from the helical axis 24. Opposite the brush tip 26, the wire axis extends longitudinally beyond the last bristle at the base 27 of the brush portion 10 and is fixedly housed in a hollow rod 28 projecting from a cylinder 30, which may function as the cap of the mascara container.

The middle section 14 of the brush 10 is generally cylindrical in shape due to the fact that the bristles 22 of this section are of relatively uniform length. The diameter of the middle section 14 of the brush portion is preferably about 0.325 inches or greater, most preferably about 0.350 inches. This diameter is significantly greater than that of the standard mascara brush, so as to facilitate use with high viscosity mascara formulations and provide maximum exposure of the brush to the lashes. Longer bristles, such as the ones used in the present invention, were formerly believed to be too flexible to provide the stiffness and control required for mascara application. However, as is further shown below, the tri-sectional configuration and combination of bristle types utilized by the present invention allows for the use of such longer bristles while maintaining the stiffness required for optimal mascara application.

The bristles 22,23 utilized in the middle cylindrical section 14 of the brush are of at least two types: preferably, at least one soft bristle type 23 for applying the mascara and at least one stiff bristle type 22 for combing the mascara through the lashes. For purposes of this application, "soft" bristles are defined as those bristles which have relatively low flexural strength, i.e., resistance to bending, whereas "stiff" bristles have substantially greater flexural strength. Bristle stiffness varies depending on the bristle material, the diameter of the bristle and the bristle length. Thus, all other things being equal, a shorter bristle is more stiff than a longer bristle and a thicker bristle is stiffer than a thin bristle. Additionally, hollow bristles are generally more flexible than solid bristles of the same material and dimensions. As used herein, solid synthetic bristles having a diameter less than 0.004 inches are considered "soft" whereas solid synthetic bristles of 0.004 inches or greater diameter are considered "stiff."

Figure 2:
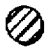
FIG. 2 is an enlarged cross-sectional view of a non-circular bristle as utilized in the middle section of a mascara brush according to an embodiment of the present invention.
Figure 3:
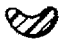
FIG. 3 is an enlarged cross-sectional view of a circular ultrafine bristle as utilized in the middle section of a mascara brush according to an embodiment of the present invention.

The bristles utilized in the present invention may exhibit a variety of the cross-sections known in the art. As shown in FIG. 2, the soft bristles are preferably of generally circular cross-section and may be formed of various synthetic fibers, such as polyamide, polyesters, polyolefin and the like. The diameter of the soft bristle fiber is preferably about 0.001 to 0.002 inches to provide the requisite suppleness for applying the mascara. As shown in FIG. 3, the stiff bristles are preferably of irregular or non-circular cross section, similar to that of natural goat hairs. These fibers may be formed synthetically from any of the known materials listed above. The preferred stiff bristle has a diameter of about 0.004 to 0.006 inches, most preferably about 0.005 inches.

The combination of stiff bristles 22 and soft bristles 23 comprising the middle section 14 of the brush are fed together through the legs of the twisted wire axis 24 and are gripped at their midpoints therein. The bristles 22,23 of the middle section 14 may be more or less densely packed than the bristles 18,20 of either of the end sections 12,16. Preferably, the density of the stiff bristles 22 of the middle section 14 is about five to ten bristles per turn, and the bristle density of the soft bristles 23 of the middle section 14 is about eighteen to thirty-two bristles per turn.

In a preferred embodiment, the stiff bristles 22 of the middle section 14 project from the wire axis 24 in a non-spiral arrangement. This non-spiral arrangement produces a fuller, more uniform bristle distribution throughout the middle section 14 of the brush.

Figure 4:
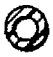
FIG. 4 is an enlarged cross-sectional view of a hollow bristle as utilized in the end section of a mascara brush according to an embodiment of the present invention.

Each of the end sections 12,16 of the brush 10 is comprised of one or more bristle types. A preferred bristle type comprises tubular fibers of hollow circular cross-section, as shown in FIG. 4. These bristles 18,20 are known to be manufactured of various synthetic materials, such as polyamide, polyesters, and polyolefins, and are available in varying diameters. A preferred embodiment utilizes a hollow nylon fiber of about 0.004 to 0.006 inches in outer diameter, most preferably about 0.005 inches.

Preferably, the diameter and stiffness of one of the bristle types used in one or both of the end sections 12,16 is the same as the diameter and stiffness of one of the bristle types used in the middle section 14 of the brush. However, neither end section will contain the same combination of bristle types as those contained in the middle section. For example, the middle section 14 may contain bristle A and bristle B and the end sections 12,16 may both contain bristle A but not bristle B. Alternatively, the tip end section 16 may contain bristle A and the base end section 12 may contain bristle B, or vice versa.

In an alternative embodiment, the bristle composition of the base end section 12 varies from that of the tip end section 16, such that the diameter and stiffness of at least one of the bristle types contained in the base end section 12 is different than the diameter and stiffness of the bristles used in the tip end section 16. For example, the tip end section 16 may more advantageously serve as a combing implement and may require a stiffer bristle type than that used in the base end section 12.

The bristle density of the end sections 12,16 may vary from that of the middle section 14. Preferably, the bristle density will vary from zone to zone, such that the middle section 14 will be less dense than the tip end section 16 and the base end section 12 will be denser still. For example, a preferred embodiment incorporates a bristle density of about twenty to forty bristles per turn in the tip end section 16 of the brush and about thirty to sixty bristles per turn in the base end section 12.

The fibers 18,20 utilized in the end sections 12,16 of the brush are gripped between the legs of the wire axis 24 at their midpoints. It is known that hollow fibers have a tendency to flare outwardly in a substantially V-shaped arrangement, thereby producing a random distribution of bristles at the face of the brush. However, it is preferred in the present invention that the end sections 12,16 of the brush maintain a spiral arrangement. Therefore, when using hollow bristles in the end sections 12,16 of the brush, the bristle density must be adjusted to assure a substantially spiral arrangement in these end sections.

Figure 5:
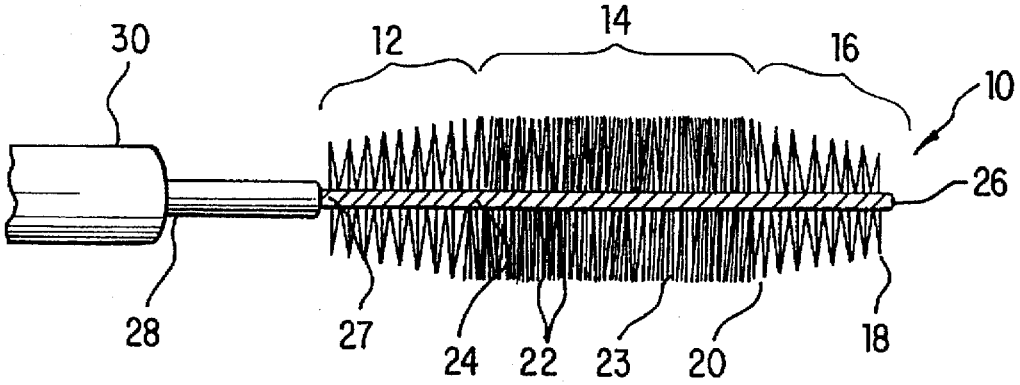
FIG. 5 is a longitudinal side view of a second embodiment of a mascara brush according to the present invention.
Figure 7:
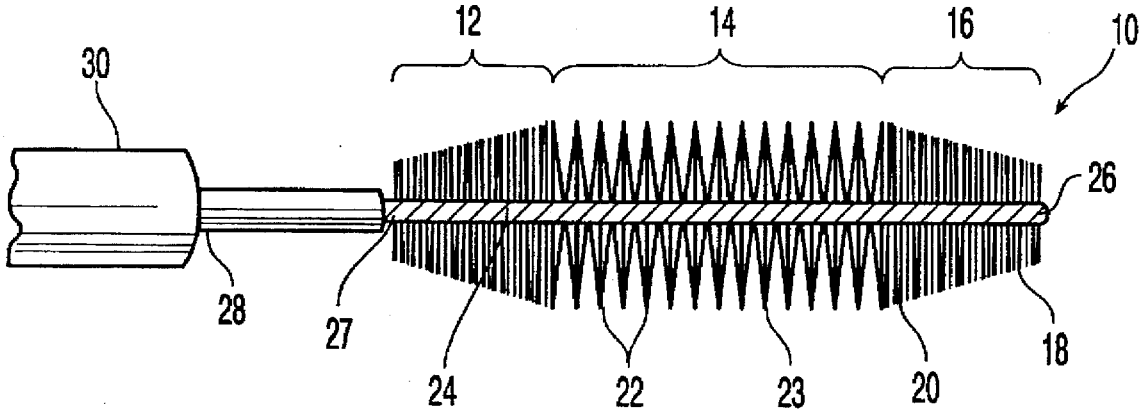
FIG. 7 is a longitudinal side view of a fourth embodiment of a mascara brush according to the present invention.

As shown in FIGS. 5 and 7, one or both of the end sections 12,16 of the brush are preferably designed to have a sharp taper such that the bristles 18 at either end of the brush are progressively shorter than those bristles 20 immediately adjacent to the middle section 14 of the brush portion 10. Unlike brushes which utilize an elliptical or football shape, the sharp taper of this preferred embodiment clearly distinguishes the end sections 12,16 of the brush from the middle section 14 of the brush. This sharp taper has several advantages. For example, the tip end section 16 is useful as a styling tool for reaching into corners and combing through the delicate lashes of the lower eyelid. On the other hand, the short, stiff bristles of the base end section 12 serve to keep the middle section 14 of the brush cleaner upon removal from a mascara container by dispensing of any excess mascara accumulated at the opening of the container before it reaches the longer, more flexible bristles 22,23 of the middle section 14. These functions are further advanced by the difference in overall effective stiffness from one zone to the next.

Therefore, while there have been described what are at present considered to be the preferred embodiments of this invention, it will be obvious to those skilled in the art that various changes and modifications may be made without departing from the invention, and it is, therefore, aimed to cover all such changes and modifications that fall within the true spirit and scope of the invention.

What is claimed is:

1. A mascara brush, comprising:

a twisted wire core extending longitudinally; and a plurality of bristles mounted to said twisted wire core, said plurality of bristles comprising:

a middle cylindrical section containing a plurality of at least first and second different bristle types of relatively uniform length intermingled throughout the length of said middle section;

two end sections containing a plurality of bristles comprising one of said first or second bristle types; and said middle section being less densely packed than at least one of said end sections.

2. A mascara brush according to claim 1 wherein said plurality of bristle types comprises at least one relatively soft bristle type and one relatively stiff bristle type.

3. A mascara brush according to claim 2 wherein the diameter of said middle cylindrical section is at least about 0.325 inches.

4. A mascara brush according to claim 3, wherein said bristle density in each said section is uniform within each section.

5. A mascara brush according to claim 3 wherein at least one of said end sections is tapered, said bristles of said end section progressively decreasing in length toward the end of said at least one tapered section.

6. A mascara brush according to claim 3 wherein said soft bristles are comprised of fibers having a diameter of about 0.001 to 0.002 inches.

7. A mascara brush according to claim 4 wherein said stiff bristles are comprised of fibers of non-circular cross-section having a diameter of from about 0.004 to 0.006 inches.

8. A mascara brush, comprising:

a tip section terminating at a tip, said tip section comprising at least first tip bristles having diameter and stiffness;

a middle section adjacent said tip section, said middle section comprising at least first middle bristle types having first diameter and stiffness and second middle bristle types having second diameter and stiffness, wherein said first and second middle bristle types are blended together in the middle section; and a base section adjacent said middle section and opposite said tip section, said base section comprising at least first base bristles having diameter and stiffness, wherein said tip bristles have first diameter and stiffness and said base bristles have second diameter and stiffness and said middle section is less densely packed than at least one of said base or tip sections.

9. A mascara brush according to claim 8, wherein said bristle types comprise at least one relatively soft bristle type and one relatively stiff bristle type.

10. A mascara brush according to claim 9 wherein the diameter of said middle section is at least about 0.325 inches.

11. A mascara brush according to claim 10, wherein said bristle density in each said section is uniform within each section.

12. A mascara brush according to claim 10 wherein at least one of said base or tip sections is tapered, said bristles of said base or tip sections progressively decreasing in length toward the end of said at least one tapered section.

13. A mascara brush according to claim 10 wherein said soft bristles are comprised of fibers having a diameter of about 0.001 to 0.002 inches.

14. A mascara brush according to claim 10 wherein said stiff bristles are comprised of fibers of non-circular cross-section having a diameter of from about 0.004 to 0.006 inches.

15. A mascara brush according to claim 8 wherein said tip section is tapered, with said tip bristles of said tip section progressively decreasing in length toward said tip.

16. A mascara brush according to claim 8 wherein said base section is tapered, with said first bristles of said base section progressively decreasing in length toward a base opposite the middle section.

17. A mascara brush according to claim 16 wherein the diameter of said middle section is at least about 0.325 inches.

18. A mascara brush, comprising:

a tip section terminating at a tip, said tip section comprising at least first bristles having a first diameter and stiffness;

a middle section adjacent said tip section, said middle section comprising at least second bristles having a second diameter and stiffness and third bristles having a third diameter and stiffness, wherein said second and third bristles are blended together in the middle section; and a base section adjacent said middle section and opposite said tip section, said base section comprising at least fourth bristles having a fourth diameter and stiffness.

* * * * *